US006572050B1

(12) United States Patent
Okada et al.

(10) Patent No.: US 6,572,050 B1
(45) Date of Patent: Jun. 3, 2003

(54) PROCESS FOR WINDING ELASTOMERIC FIBER PACKAGE

(75) Inventors: Tatsuyuki Okada, Kyoto (JP); Hidekazu Iketani, Otsu (JP)

(73) Assignee: Dupont-Toray Co. Ltd., Tokyo ( * ) Notice: Subject to any disclaimer, the term of this patent is extended or adjusted under 35 U.S.C. 154(b) by 0 days.

(21) Appl. No.: 09/958,994

(22) PCT Filed: Apr. 10, 2000

(86) PCT No.: PCT/US00/09544

§ 371 (c)(1),
(2), (4) Date: Oct. 15, 2001

(87) PCT Pub. No.: WO00/61484

PCT Pub. Date: Oct. 19, 2000

(30) Foreign Application Priority Data

Apr. 14, 1999 (JP) ..... 11-106859

(51) Int. Cl.[7] ..... B65H 54/42
(52) U.S. Cl. ..... 242/486.4
(58) Field of Search ..... 242/486.1, 477.1

(56) References Cited

U.S. PATENT DOCUMENTS

| | | | | |
|---|---|---|---|---|
| 2,753,125 A | | 7/1956 | Wurmli | |
| 3,661,334 A | * | 5/1972 | Graf | 242/486.4 |
| 3,672,583 A | | 6/1972 | Harrison | |
| 5,407,143 A | * | 4/1995 | Nakai et al. | 242/474.5 |
| 5,409,173 A | * | 4/1995 | Fahmuller et al. | 242/486.4 |
| 5,727,744 A | | 3/1998 | Threlkeld et al. | |
| 6,105,896 A | * | 8/2000 | Westrich | 242/474.5 |
| 2002/0053623 A1 | * | 5/2002 | Tone | 242/486.4 |

* cited by examiner

*Primary Examiner*—Michael R. Mansen

(57) ABSTRACT

A winding process for an elastomeric fiber package using a contact roll that exerts variable pressure during the winding to create an elastomeric fiber package with a good package shape. The method including having a high initial force of the contact roll of less than 10 kg, reducing the force to about 25–60% of the initial force during the first 30% of winding time, then holding the force substantially constant until the final 30% of the winding time when the force is reduced to about a final force of 10–35% of the initial force. Wherein the final force is no less than about 1 kg and the package size is at least 4 kg.

2 Claims, 3 Drawing Sheets

PROCESS FOR WINDING ELASTOMERIC FIBER PACKAGE

BACKGROUND OF THE INVENTION

1. Field of the Invention

The present invention relates to a winding process for an elastomeric fiber package and, more particularly, to a process for winding a package utilizing a contact roll exerting variable pressure during the winding.

2. Description of Background Art

Products based on elastomeric fibers have been used in many areas such as industrial materials, clothing, and disposable personal care products (for example diapers). The elastomeric fibers have been woven and knit into fabrics, stitch-bonded into nonwovens, and directly adhered onto sheet materials such as nonwovens and films. The elastomeric fiber is ordinarily provided wound onto tubecores. The woundfiber and associated tubecore are referred to as a "package". In use, the elastomeric fiber is unwound from the package sequentially or in parallel, either passively (for example, by "over-end take-off") or actively (for example by "rolling take-off"), and fed to a downstream process.

However, there have been problems in that elastomeric fiber packages have heretofore sometimes had poor package shape. Such packages have been wound with rising force of the contact roll on the tubecore and package. This poor package shape can cause the elastomeric fiber to slough off the package readily (for example as a result of rubbing against shipping materials or other elastomeric fiber packages) so that the unwinding elastomeric fiber becomes entangled with the sloughed-off elastomeric fiber, leading to breaks in the fiber. Such breaks also occur as a direct result of the rubbing. As a result, the economics of unwinding fibers from such packages were poor, and an improved process for winding elastomeric fiber packages is needed.

SUMMARY OF THE INVENTION

The process for winding an elastomeric fiber producing an inflected force profile, comprises the steps of:

(A) rotating a tubecore in contact with a contact roll;

(B) winding the fiber onto the tubecore so that the contact roll exerts an initial force against the fiber on the tubecore and a package begins to be formed;

(C) gradually reducing the force a first time during the first 30% of winding time to approximately 25–60% of the initial force;

(D) holding the force substantially constant until the final 30% of winding time; and (E) reducing the force a second time to no less than approximately 10% of the initial force.

DETAILED DESCRIPTION OF THE INVENTION

It has now been found that an elastomeric fiber package, especially a large package which has good unwinding characteristics and excellent package shape, can be made by winding the package with an inflected force profile.

"Elastomeric fiber" means a filament which has a break elongation in excess of 100% independent of any crimp and which when stretched and released, retracts quickly and forcibly-to substantially its original length. Such fibers include rubber fiber, spandex or elastane, polyetherester fiber, polyetheramide fiber, certain polypropylenes, and elastoester. "Spandex" and. "elastane" mean a manufactured fiber in which the fiber-forming substance is a long chain synthetic elastomer comprised of at least 85% by weight of a segmented polyurethane. "Inflected force profile" means a plot of the package diameter vs the force of the contact roll against the tubecore and winding package, the plot having a change of curvature, with respect to a fixed line, from concave to convex, or conversely, depending on the point from which the plot is viewed.

Synthetic elastomeric fibers such as elastane, polyetheramide fibers, and polyetherester fibers can be prepared from polymeric glycols; copolymeric glycols can also be used. In the case of elastane, the polymeric glycol can be a (co) polyether glycol, (co)polyester glycol, and/or (co) polycarbonate glycol. The polymeric glycol is typically reacted with a diisocyanate and at least one diamine, alkanolamine, and/or diol to form the polymer. In the case of polyetheresters, a polyether glycol can be reacted with a diacid and at least one low-molecular weight diol to form the polymer. Polyether diamines, diacids, and low molecular weight diamines can be used to make polyetheramides. Monofunctional chain terminators such as alcohols and amines can be used to control the molecular weight of the polymers.

Depending on the type of polymer to be made, solution- or melt-polymerization can be used. Correspondingly, dry-, wet-, or melt-spinning can be used to prepare the fiber, depending on the type of polymer. Additives and stabilizers can be added to the fiber, provided they do not adversely affect the process of the invention.

After the fiber has been spun, it is typically reciprocated transversely to the direction of its travel by a traverse means and wound up on a tubecore. The tubecore is customarily mounted on a spindle assembly, and the fiber is wound onto the tubecore with the aid of a contact roll. The spindle assembly can be driven and the contact roll can be undriven (freely rotating). Alternatively, the spindle assembly can be undriven, and the contact roll can be driven, thus providing the rotational drive needed to rotate the spindle assembly.

Figure 2:
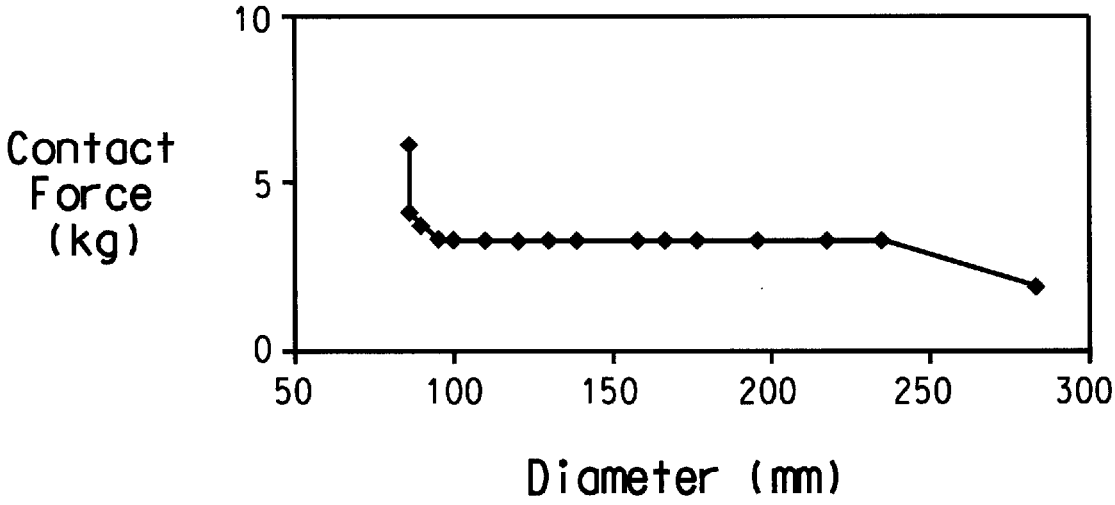
FIG. 2 is a plot of the force that the contact roll exerts against the tubecore and package vs package diameter from the beginning of winding to the end of winding in the process of the present invention. This is an example of an inflected force profile.

In the process of the present invention, the force exerted by the contact roll on the tube core (and after winding begins, on the growing package) is reduced during winding according to a specific profile. The force reductions are described herein by reference to the force used at the beginning of winding (the "initial force"). The maximum initial force can be 10 Kg, and the minimum force can be 1 Kg. During the first 30%, preferably 10%, of winding time, the force is gradually reduced a first time, to about 25–60% of the initial force. The contact roll force is then held substantially constant until the final 30%, preferably about 20%, of the winding time at which point the force is reduced a second time to no less than about 10%, preferably about 10–35%, of the initial force. Winding time corresponds approximately to package diameter, and plotting the contact roll force against the diameter of the winding package gives an inflected force profile as illustrated in FIG. 2.

Figure 1:
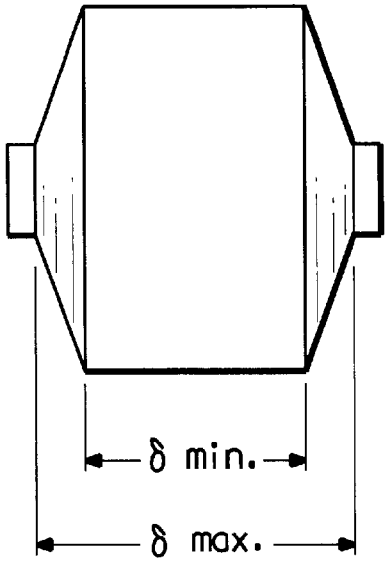
FIG. 1 is a schematic side view illustrating an elastomeric fiber package obtained by the process of the invention.

The method of this invention provides an elastomeric fiber package which has a substantially uniform wound width, thereby providing excellent unwinding and shape retention properties. That is, the present invention produces a package as illustrated in FIG. 1, which has a small difference $\delta_\omega$ between the maximum value $\delta_{max}$ and the minimum value $\delta_{min}$ of the wound package width. A small $\delta_\omega$ indicates sidewalls that are desirably substantially flat and perpendicular to the axis of the tubecore; such packages have good unwinding characteristics.

The process of the invention is especially useful for elastomeric fiber packages weighing 3 kg or more and even exceeding 4 kg.

Figure 5:
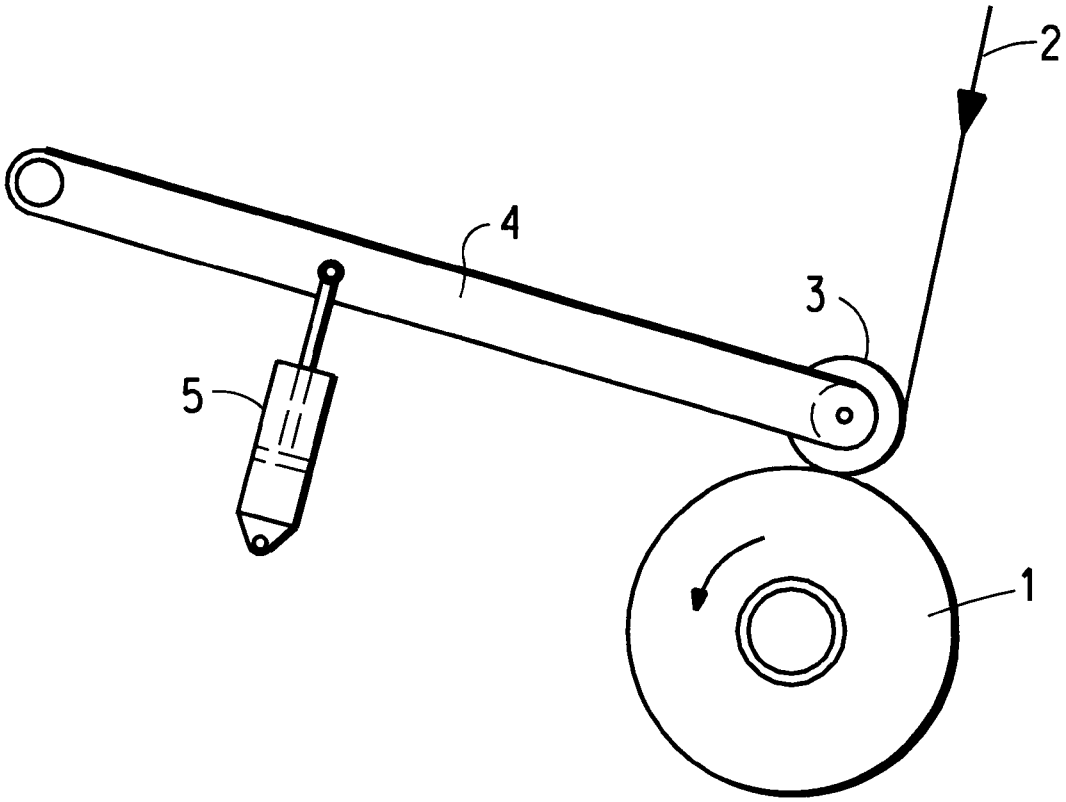
FIG. 5 schematically illustrates an example of a means that can be used in the present process to vary the force that the contact roll exerts against the elastomeric fiber package.

Any suitable method can be used in this invention as a means to control and vary the force that the contact roll exerts against the package. For example, an apparatus as illustrated in FIG. 5 can be used in which compressed air cylinder 5 operates on signals from a control device (not shown) to adjust the weight of arm 4 that supports contact roll 3 which rotates in contact with tubecore and package 1 as elastomeric fiber 2 is wound up. Thus when the cylinder is extended, the contact roll force is reduced, and when it is contracted, the force is increased. A hydraulic cylinder can be used in place of the air cylinder. Other geometries can also be used to obtain the inflected force profile of the invention.

EXAMPLE 1

A 560 denier (622 dtex) Lycra® spandex (Type 127; a registered trademark of E. I. du Pont de Nemours and Company) was dry-spun by conventional means and wound up on a 175-mm long tubecore to reach a wound package weight of 4.5 kg. No finish was applied to the fiber. The force that the contact roll exerted against the package during winding followed the inflected force profile shown in FIG. 2, in which package diameter (in mm) is plotted on the abscissa and the force that the contact roll exerts against the package (in Kg) is plotted on the ordinate. As shown in FIG. 2, the total winding diameter was about 282 mm. The beginning of winding, during which the contact roll force was reduced a first time, was about 9 mm (5% of the total diameter and about 5% of the total winding time), and the end of winding during which the force was reduced a second time was about 46 mm (24% of the total diameter and about 24% of the total winding time). The force declined from about 5.7 Kg at the beginning of winding to about 2.9 Kg during the middle of winding, or to about 50% of the initial force. The contact roll force was held substantially constant until the end of winding, at which point it was reduced further to about 31% of the initial force, in other words to about 1.8 Kg. As shown in Table 1, the difference in wound width was small and the product had excellent sidewall shape and unwinding characteristics.

Comparative Example 1

Figure 3:
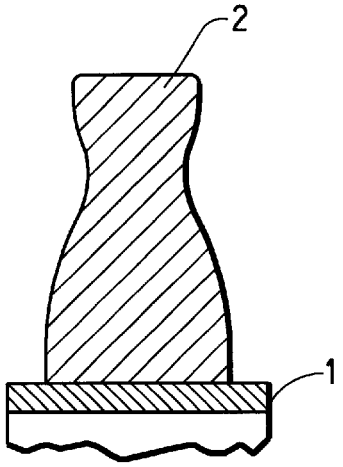
FIG. 3 (PRIOR ART)
FIG. 3 shows a cross-section of an elastomeric fiber package made by conventional winding.
Figure 4:
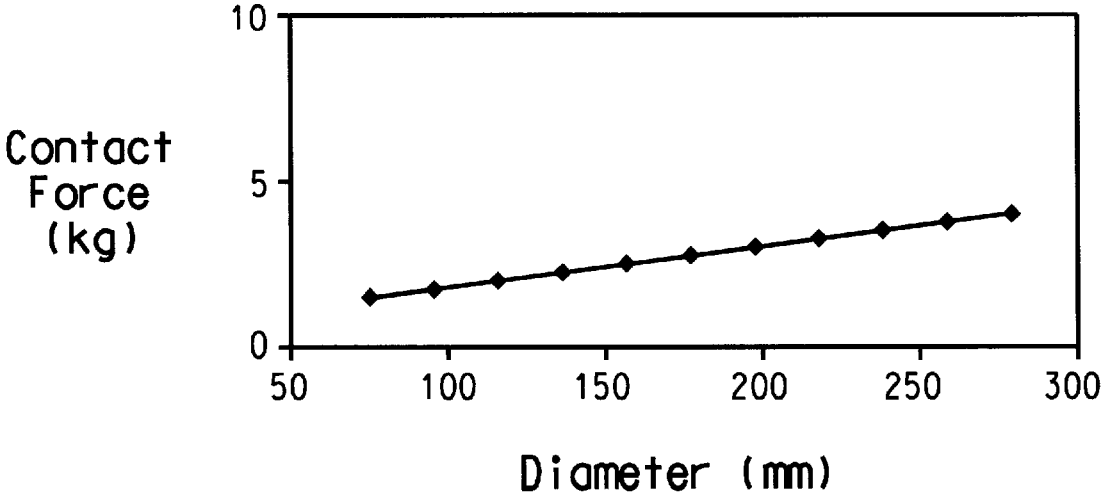
FIG. 4 (PRIOR ART)
FIG. 4 illustrates an example of an uninflected force profile as used in a conventional winding process.

Elastomeric fiber was spun and wound up exactly as in Example 1 except that the force that the contact roll exerted against the package was increased as during conventional winding and as shown in FIG. 4. As reported in Table 1, the resulting package had a wound width greater than that of the package of Example 1, showed inferior unwinding characteristics, and had an S-shape (substantial bulge) in the sidewall as illustrated in FIG. 3.

TABLE 1

| | Example 1 | Comp. Example 1 |
|---|---|---|
| The curve shape of the force that contact roll exerts against package | Inflected force profile, as in FIG. 2 | Linear, as in FIG. 4 |
| Difference in wound width $\delta_w$ (mm) | 16 | 30 |
| Sidewall shape | Gentle curve | S-shaped, with large bulge |
| Unwinding characteristics | Good | Poor |

What is claimed is:

1. A process for winding an elastomeric fiber (2), comprising the steps of:

(A) rotating a tubecore in contact with a roll (3);

(B) winding the fiber onto the tubecore so that the contact roll exerts an initial force no greater than about 10 kg against the fiber on the tubecore and a package (1) begins to be formed;

(C) reducing the force a first time to about 25–60% of the initial force during the first 30% of winding time;

(D) holding the force substantially constant until the final 30% of winding time; and (E) reducing the force a second time to about a final force that is 10–35 k of the initial force, wherein the final force is no less than about 1 kg and the package size is at least 4 kg.

2. The process of claim 1 wherein the force is reduced a first time during about the first 10% of winding time and the force is reduced a second time during about the final 20% of winding time.

* * * * *

UNITED STATES PATENT AND TRADEMARK OFFICE

CERTIFICATE OF CORRECTION

PATENT NO. : 6,572,050 B1
DATED : June 3, 2003
INVENTOR(S) : Tatsuyuki Okada et al.

It is certified that error appears in the above-identified patent and that said Letters Patent is hereby corrected as shown below:

Column 4,
Line 46, "10-35 k" should read -- 10-35% --.

Signed and Sealed this

Fifth Day of October, 2004

JON W. DUDAS
*Director of the United States Patent and Trademark Office*